US006393131B1

(12) United States Patent
Rexroat

(10) Patent No.: US 6,393,131 B1
(45) Date of Patent: May 21, 2002

(54) LOUDSPEAKER

(76) Inventor: Scott Michael Rexroat, 3100 27th Street Dr., Moline, IL (US) 61265

( * ) Notice: Subject to any disclaimer, the term of this patent is extended or adjusted under 35 U.S.C. 154(b) by 0 days.

(21) Appl. No.: 09/595,712

(22) Filed: Jun. 16, 2000

(51) Int. Cl.[7] ..... H04R 1/02

(52) U.S. Cl. ..... 381/342; 381/341; 381/182; 381/339; 381/337; 181/188; 181/187

(58) Field of Search ..... 381/342, 340, 381/351, 82, 182, 386, 339; 181/152, 159, 177, 179, 144, 145, 153

(56) References Cited

U.S. PATENT DOCUMENTS 3,707,201 A * 12/1972 Domin et al. ..... 181/145
5,000,286 A * 3/1991 Crawford et al. ..... 181/145
6,009,182 A * 12/1999 Gunness ..... 381/182
6,016,353 A * 1/2000 Gunness ..... 381/342

* cited by examiner

*Primary Examiner*—Sinh Tran

(57) ABSTRACT

A loudspeaker includes a cabinet designed so as to define a central compartment sandwiched between upper and lower compartments. The cabinet is symmetrical about a vertical central, fore-and-aft extending plane. Located in each of the upper and lower compartments are a pair of vertical horn walls which are exponentially curved and diverge forwardly from an inlet located at a rear part of the respective compartments, to the front of opposite side walls of the cabinet. These horn walls define bass horns which have drivers coupled to their inlets. Located in the middle compartment and diverging at an angle of 15° from each other are a pair of mid/high frequency horns that are each formed by a pair of vertical horn walls that are exponentially curved and diverge forwardly from respective inlets located in a rear part of the middle compartment on opposite sides of the plane. Co-axially mounted mid frequency and high frequency drivers or transducers are mounted to the inlets of each of these horns and operate to reproduce frequencies within the entire vocal range. The cabinet has opposite side walls which are angled so as to permit several cabinets to be arrayed with their planes of symmetry intersecting at a single axis so that the sound from all of the horns emanates from a single point source.

13 Claims, 3 Drawing Sheets

LOUDSPEAKER

The present invention relates to a loudspeaker and more specifically, relates to a loudspeaker particularly adapted for concert use.

BACKGROUND OF THE INVENTION

Reproducing or amplifying sound in a high fidelity manner is not an easy task to achieve. In order to do so, many requirements must be met. One basic requirement is that the loudspeaker reproduce all of the vocal range of sound (~250 hz to 4000 hz), the most sensitive range of human hearing, and project or shoot these highly intelligible vocals far through crowds. Although it has long been known in the loudspeaker art to incorporate direct radiating horns having continuously varying, exponential contours for sound reinforcement applications, heretofore the horn configurations used have resulted in there being a crossover point in the vocal range causing phasing problems between the mid-range and high frequency transducers or drivers.

SUMMARY OF THE INVENTION

According to the present invention, there is provided an improved loudspeaker suitable for concert use in that the loudspeaker is capable of high fidelity sound reproduction.

A broad object of the invention is to provide a loudspeaker design which overcomes the drawbacks of prior art loudspeakers.

An object of the invention is to provide a loudspeaker design wherein multiple horns are efficiently arranged in a speaker cabinet so that sound radiates from a point source and so that the sound projected from the speaker is free of a crossover point in the vocal range.

A more specific object of the invention is to provide a loudspeaker including a cabinet designed to include a pair of mid/high frequency horns located side-by-side and sandwiched between upper and lower bass horns, the mid/high frequency horns each reproducing sound over the entire vocal range of sound frequencies.

Yet another object of the invention is to provide a loudspeaker design, having the architecture set forth above, which is particularly adapted for being arrayed with other like loudspeakers, and when so arrayed, having their bass horns combine efforts in the frequencies below horn cutoff to thereby obviate the need for sub-woofers, thus eliminating a third crossover point from the system.

These and other objects will become apparent from a reading of the ensuing description together with the appended drawings.

DESCRIPTION OF THE PREFERRED EMBODIMENT

Figure 1:
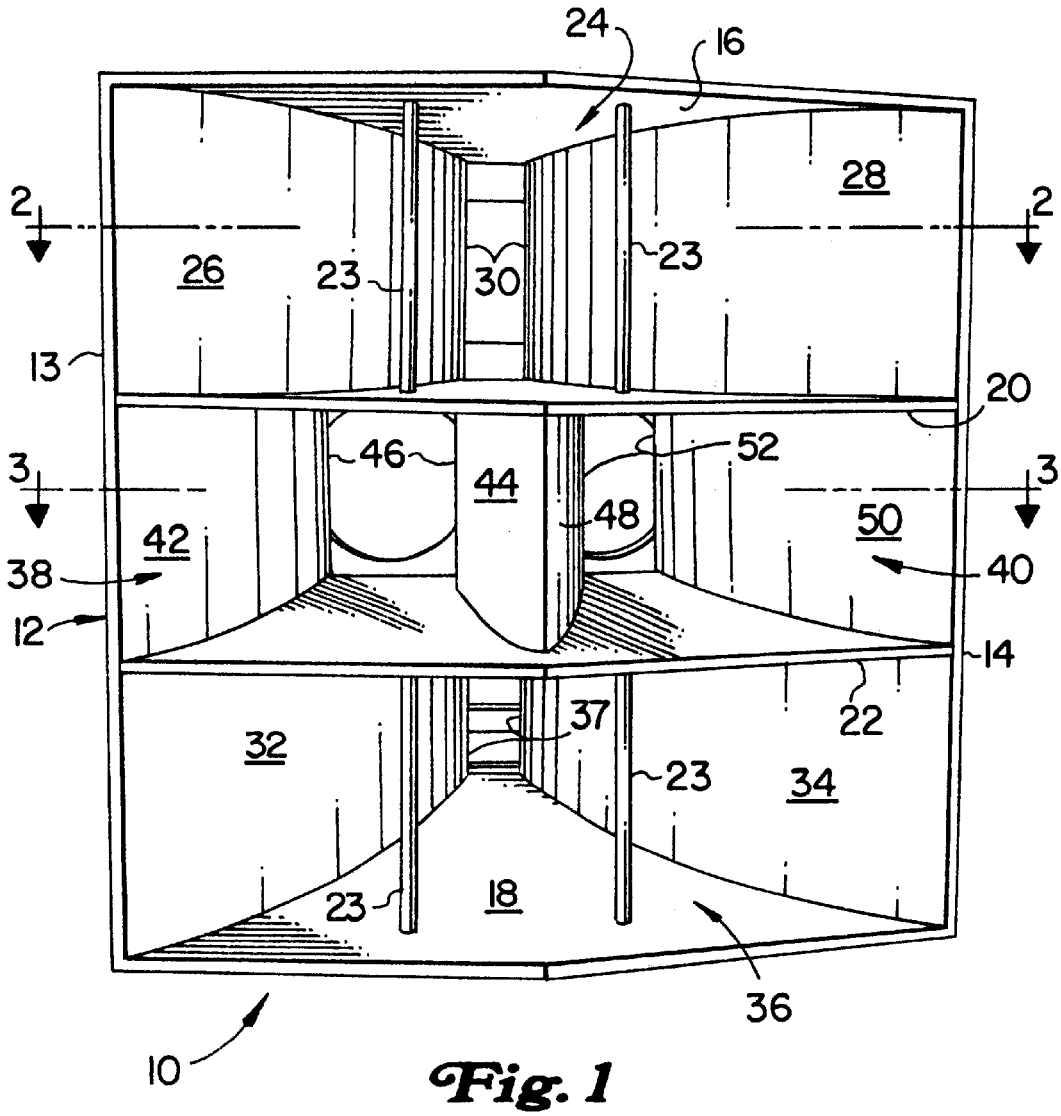
FIG. 1 is a front perspective view showing the loudspeaker of the present invention.
Figure 2:
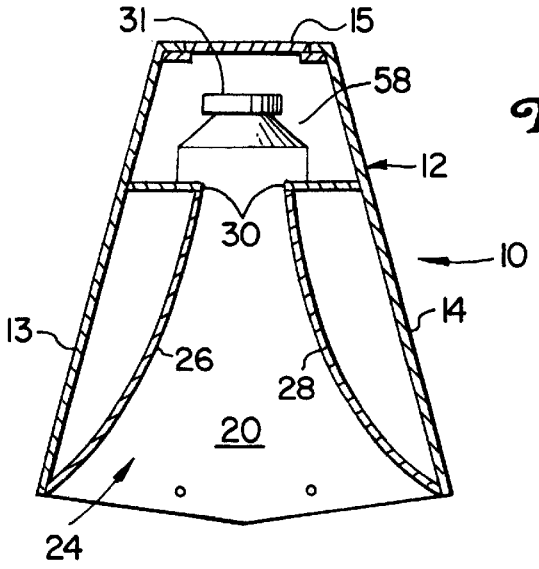
FIG. 2 is a horizontal sectional view taken along line 2—2 of FIG. 1.
Figure 3:
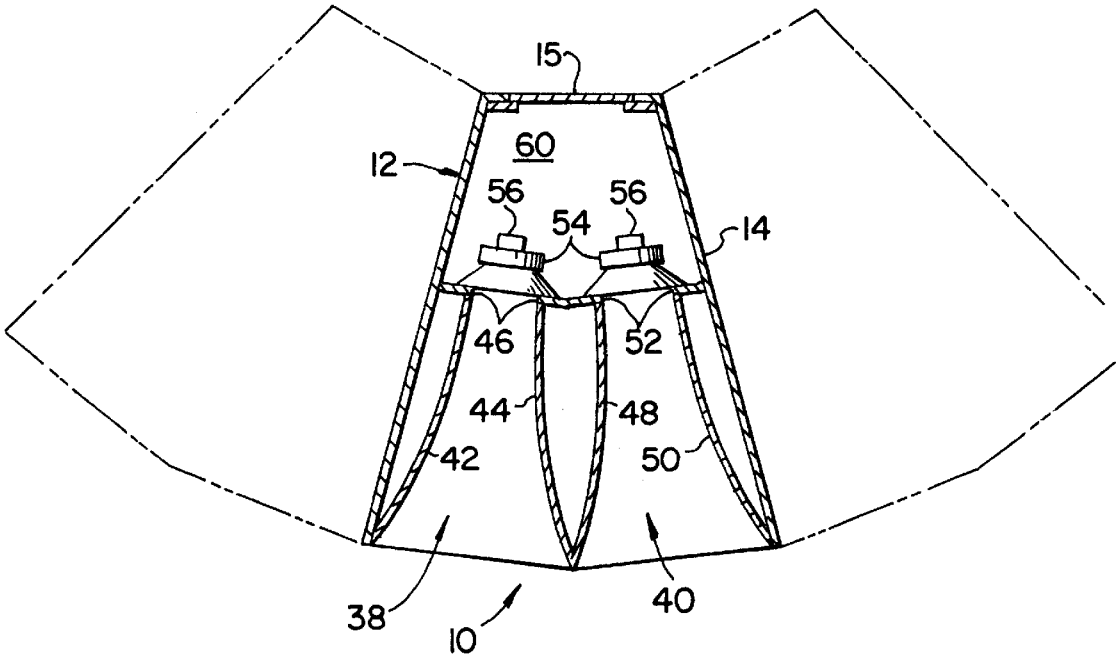
FIG. 3 is a horizontal sectional view taken along line 3—3 of FIG. 1 and further showing the outline of two other loudspeakers arrayed with the sectioned loudspeaker.

Referring now to FIGS. 1–4, there is shown a loudspeaker 10, including a cabinet 12, which, as viewed from the rear, includes right- and left-hand side walls 13 and 14, respectively, joined to a rear or access wall 15 and opposite edges of identical generally trapezoidal top bottom, upper interior and lower interior walls 16, 18, 20 and 22, respectively. Although other angles would be functional, preferably the side walls 13 and 14 each make an angle of 105° with the rear wall 15 so that they diverge in the forward direction. In other words, the side walls 13 and 14 each make an angle of 15° with a line that is perpendicular to the rear wall 15. The significance of this angle of divergence is explained below. The distance between the top wall 16 and the upper interior wall 20 is equal to the distance between the bottom wall 18 and the lower interior wall 22, while the interior walls 20 and 22 are spaced from each other by a slightly smaller distance. Thus, the interior walls 20 and 22 act to divide the cabinet 12 into identical upper and lower cells or sections that sandwich a middle section. Located front and center and extending vertically between the top wall 16 and the upper interior wall 20 are an upper pair of transversely spaced stiffener posts 23 while a lower pair of stiffener posts 23 are likewise located between the lower wall 18 and the lower interior wall 22.

Extending between the top wall 16 and the upper interior wall 20 and cooperating therewith to define an upper bass horn 24 are right- and left-hand, upright horn walls 26 and 28 having continuously varying exponential contours cooperating to define an inlet or throat 30 at a location centered between the side walls 13 and 14, and spaced towards the front of the cabinet 12 from the back wall 15 by approximately one-third of the distance from the back wall 15 to the front of the cabinet 12. The horn walls 26 diverge from each other in the forward direction and are respectively joined to forward ends of the side walls 13 and 14 so as to define an exit or mouth. A bass transducer or driver 31 (FIG. 2) is coupled to the inlet 30 of the bass horn 24.

Similarly, right- and left-hand horn walls 32 and 34 extend between and cooperate with the bottom wall 18 and the lower interior wall 22 to define a lower bass horn 36 that is identical to the upper bass horn 24. Mounted at an inlet or throat 37 of the bass horn 36 is a bass horn driver or transducer (not shown) that is identical to the driver 31.

Located in the space between the upper and lower interior walls 20 and 22 are right-and left-hand mid/high frequency horns 38 and 40, respectively. Extending vertically between and cooperating with the upper and lower interior walls 20 and 22 to define the right-hand horn 38 are right- and left-hand horn walls 42 and 44, each having a continuously varying exponential curvature. Rear ends of the horn walls 42 and 44 are spaced from each other to define a horn inlet or throat 46 that is a little less than half the distance between the rear wall 15 and the front of the cabinet 12, the horn walls 42 and 44 diverging towards the front of the cabinet 12 from the inlet 46, with the right-hand horn wall 42 terminating at the front of the right-hand side wall 13, and with the left-hand horn wall 44 terminating at the front of the cabinet 12 at a location midway between the side walls 13 and 14. In a similar fashion, right- and left-hand horn walls 48 and 50 extend vertically between and cooperate with the upper and lower interior walls 20 and 22 to define the left-hand mid/high frequency horn 40. The rear ends of the horn walls 48 and 50 are spaced from each other to define an inlet or throat 52 from which they diverge towards, and respectively terminate at, a location at the front of the cabinet 12, midway between the side walls 13 and 14 and at the front of the side wall 14. Mounted at each of the horn inlets or throats 46 and 52 is a mid-frequency driver or transducer 54. Screwed co-axially into each mid range frequency transducer 54 is an exit high frequency driver or transducer 56. Thus, the sound generated by each coaxially arranged set of the mid- and high-frequency transducers 54 and 56, respectively enters at the associated inlet or throat 46 or 52 of the associated mid/high frequency horn 38 or 40 and exits at the mouth defined at the front of the loudspeaker 10. In the preferred embodiment, the mid-frequency transducers are 12" transducers, while the high-frequency transducers are 1" transducers. The orientation of the mid/high frequency horns 38 and 40 is such that their geometric centers are located in vertical planes that make an angle of 15° with each other, the mouths of the horns 38 and 40 together covering the entire 30° span of the front of the loudspeakers 10. It is important to note that the bass transducers 31 and the mid/high-frequency transducers 54/56 are respectively enclosed in sealed chambers 58 and 60 (FIGS. 2 and 3) so that they do not interact with each other. The power supply for the transducers 31, 54 and 56 is coupled to a jack (not shown) mounted in the rear or access wall 15.

While it is preferred that each of the horns 24, 36, 38 and 40 be defined by smooth continuously variable, exponential curves, it is thought that loudspeakers including horns defined by other smooth curves or other shapes may benefit just from the horns being arranged within a cabinet so that the mid/high frequency horns are sandwiched between bass horns in a manner similar to the way the mid/high frequency horns 38 and 40 are sandwiched between the bass horns 24 and 36.

While other dimensions would be workable, it has been found than an especially efficient loudspeaker 10 results if the cabinet 12 is dimensioned so as to be approximately 48" high×48" wide (front), 21" wide (rear)×54" deep, with the upper and lower interior walls 20 and 22 being respectively spaced from the top and bottom walls by 16" and from each other by 13". The upper and lower bass horns 24 and 36 are each approximately 35" long×46½" wide (exit)×16" high; and the sandwiched mid/high frequency horns are each approximately 30" long×23" wide (exit)×13" high. Thus, the total frontal area of the loudspeaker 10 is approximately 16 $ft^2$, and sound exits approximately 100% of this area, this efficiency being made possible due to the fact that the horn mouths touch.

Figure 5:
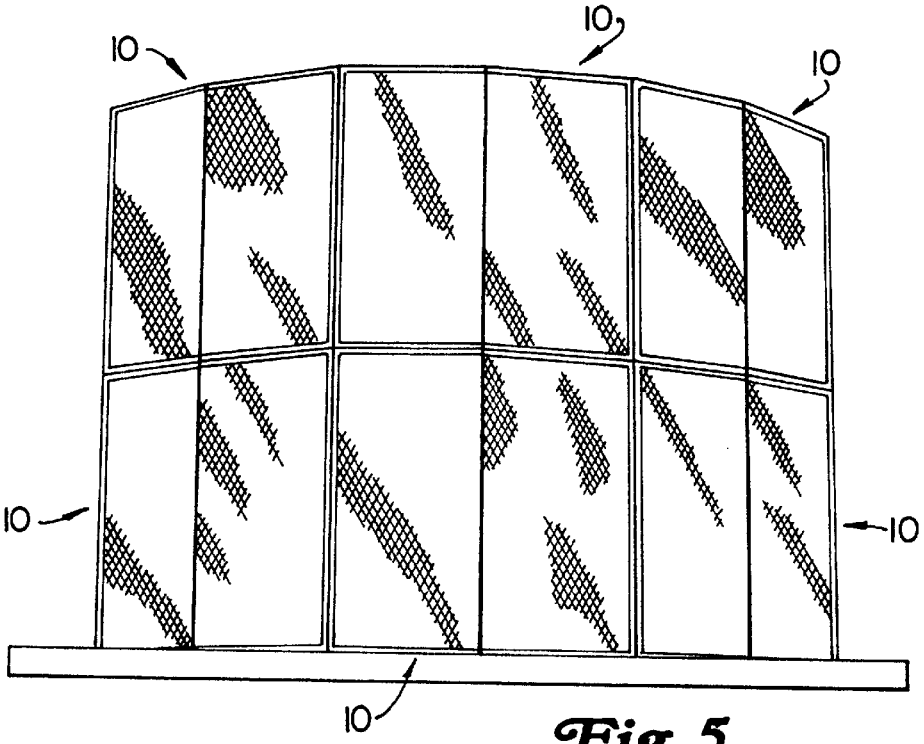
FIG. 5 is a front view showing an array of six loudspeakers constructed in accordance with the principles of the present invention.
Figure 4:
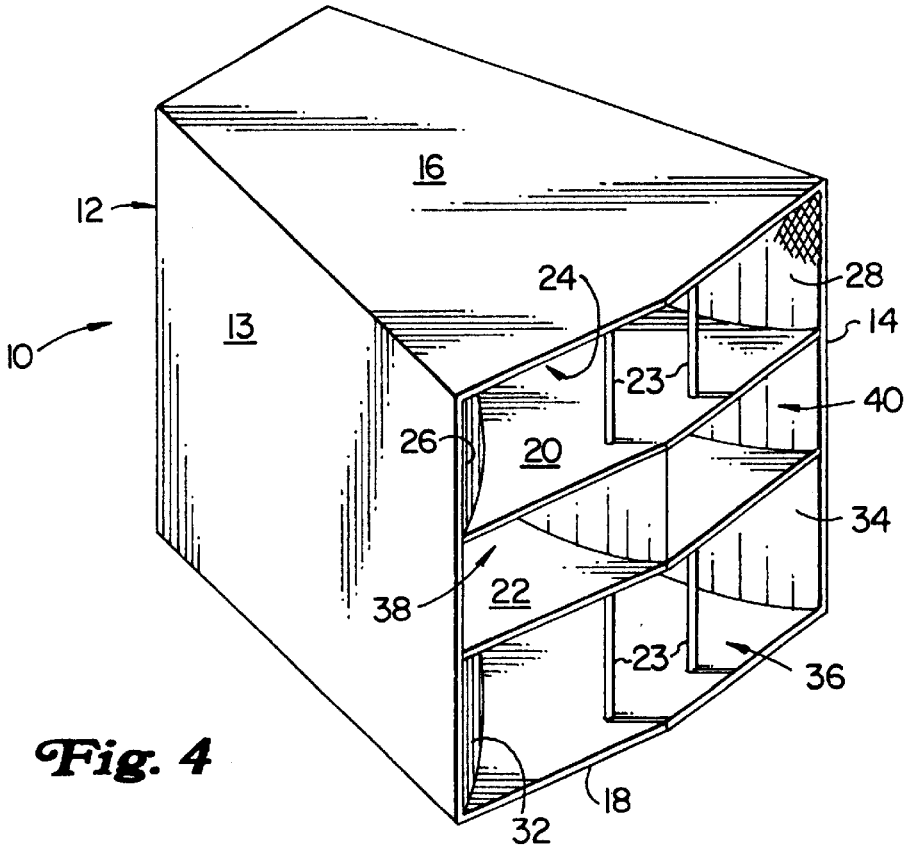
FIG. 4 is a right front perspective view of the loudspeaker shown in FIG. 1.

Referring now to FIG. 5, there is shown an array of six identical loudspeakers 10, as might be used at a concert, for example. In this array, the loudspeakers 10 are stacked so that three side-by-side disposed loudspeakers are located on top of three other side-by-side disposed loudspeakers. It is noted that while not shown in the drawing best results are obtained if the top three loudspeakers 10 are angled, from rear to front, at approximately 10° relative to the bottom three loudspeakers. This can be done with appropriately shaped shims. Each loudspeaker 10 covers a 30° arc at a radius about the axis of the intersection of the central planes of each of the loudspeakers so that the arrayed loudspeakers 10 combine to cover an arc of 90°. Of course, further loudspeakers could be added so as to cover even more area.

In operation of the preferred embodiment, it has been found that, with the two 30" long mid/high frequency horns 38 and 40 mounted sandwiched between the two 46½" wide and 35" long bass horns 24 and 36 and disposed so that their centers radiate at 15° from each other, the loudspeaker 10 actually sounds high fidelity before horn focus (approximately 50') and well after. This is due, at least in part, to the fact that the mid-frequency transducers 54 and the high-frequency transducers 56 are coaxial and thus help to create a point source wave front including both mid and high frequencies. The 30" long mid/high frequency horns 38 and 40 control the directivity of the 12" mid-frequency transducers well enough to allow them to reproduce smoothly all of the vocal range, i.e., frequencies in the range of approximately 250 hz to 4000 hz. Thus, this range of sounds does not need to be divided up among different types of drivers. Without a crossover point being in the middle of the vocal range, the loudspeaker 10 is capable of projecting or shooting highly intelligible vocals far through crowds. It follows then that phasing problems are greatly reduced.

The bass horns 24 and 36 are also designed to not have to divide sound at wrong frequencies. Specifically, the bass horns 24 and 36 load their 15" transducers or drivers 31 down to 80 hz which is better directivity control than any other full range concert loudspeaker known in the prior art. Because the side walls 13 and 14 of the cabinets 12 each make an angle of 15° with respective vertical planes disposed at a right angle to the back wall 15, several of the loudspeakers 10 may be easily and efficiently arrayed in side-by-side relationship and also stacked, as shown in FIG. 5, with the horn mouths of each loudspeaker 12 in the array emitting sound from a one point source over almost 100% of a 30° arc. When several of the loudspeakers 10 are arrayed, their bass horns 24 and 36 combine efforts in the frequency below horn cutoff frequency, which is calculated to be 80 hz, although the bass horns 24 and 36 themselves will increase sensitivity of the bass drivers 31 to below 40 hz., thus making it possible to do away with the need for sub-woofers which rids the system of a third crossover point. At frequencies below the 80 hz horn cutoff frequency of the bass horns 24 and 36, an array of several loudspeakers 10 will utilize all of the bass horns in reproducing the bottom two octaves. This coupling effect has few phasing problems due to the long wavelengths in this low frequency region, allowing the perception of one sound source emitting sounds exceeding the range of 20 hz to 20 khz. When utilized in six module arrays or more, flat response all the way down into the bottom octave is easily attainable, at inside or outside venues. Flat, deep and powerful bass response is extremely critical when realism is attempted in sound reinforcement. Furthermore, with all this esoteric bass coming from the same point in space and time as the mid/high frequencies, absolute high fidelity can be obtained for large events.

It is to be noted that best results will be achieved if the loudspeakers 10 are operated by a sufficiently sophisticated crossover system along with digital time alignment. A digital loudspeaker management system, or an integrated signal processor is recommended. A 12 db per octave, phase aligned, crossover at 4 khz to separate the mid/high frequency transducers 54 and 56 should be used, with a Linkwitz-Riley crossover being recommended. Because the human ear is most sensitive in the vocal range, no crossover point should occur in the range between approximately 250 hz to 4000 hz, a result that is possible because the mid/high frequencies are both emitted from the mouth of each of the horns 38 and 40. This crossover point, that usually plagues sound reinforcement systems with all kinds of problems, is a non-issue because a properly operated loudspeaker 10 realizes this point a more than an octave higher. This crossover scheme has been found to allow the vocal range to be realized more naturally than expected from a concert loudspeaker. The crossover between the bass and mid frequency horns may be realized at any point deemed appropriate; 24 db/octave between 120 hz and 200 hz, or 12 db/octave between 200 hz to 300 hz are recommended. Depending on the needed sound projection distance of specific applications, different crossovers may be used. Although the loudspeaker 10 is intended for large scale, long projection distance applications using large arrays of the loudspeakers, the loudspeaker 10 actually exhibits extreme clarity and smoothness up close as well.

What is claimed is:

1. A loudspeaker, comprising: a cabinet formed symmetrically about a central, vertical, fore-and-aft extending plane and being compartmentalized to define a mid/high frequency horn section sandwiched between upper and lower low frequency horn sections; said mid/high frequency horn section containing a pair of mid/high frequency horns respectively located on opposite sides of said plane and each including a pair of vertical, exponentially curved horn walls diverging from each other from an inlet, located towards a rear side of said cabinet, to an exit at a forward side of said cabinet; and each of said low frequency horn sections defining a low frequency horn including a further pair of vertical, exponentially curved horn walls diverging from each other from a further inlet centered on said plane, at a locations towards the rear side of said cabinet, to an exit at said forward side of said cabinet having a width equal to a combined exit width dimension of said mid/high frequency horns; a mid frequency transducer being mounted to each inlet of each mid/high frequency horn, and a high frequency transducer being co-axially mounted within each mid frequency transducer; said mid and high frequency transducers being capable of reproducing sound at least over the vocal range; and a bass transducer being coupled to the inlet of each said low frequency horn.

2. The loudspeaker, as defined in claim 1, wherein said opposite side walls diverge forwardly at approximately 15° from respective vertical planes, which are parallel to said central plane, whereby a plurality of cabinets may be arrayed together.

3. The loudspeaker, as defined in claim 1, wherein said mid/high frequency horns are disposed at 15° from each other, with their respective exits combining to cover an arc of 30° about a center defined at an intersection of said respective vertical planes.

4. The loudspeaker, as defined in claim 1, wherein said mid and high frequency transducers, and each said bass transducer are located in respective chambers sealed from each other so that the mid and high frequency transducers do not interact with either bass transducer.

5. The loudspeaker, as defined in claim 1, wherein said mid/high frequency horns are each approximately 30" in length and 23" wide at their exits, while each said low frequency horn is approximately 35" long and 46½" wide at its exit.

6. A loudspeaker, comprising: a cabinet formed symmetrically about a vertical, fore-and-aft extending central plane and including horizontal top and bottom walls, and upper and lower interior walls joined to opposite side walls; a first pair of right-and left-hand horn walls extending between and cooperating with said top and upper interior walls to define an upper bass horn; said first pair of horn walls having respective rear ends spaced from each other at opposite sides of said plane at a first location towards a rear side of said cabinet so as to define a first horn throat from which said first pair of horn walls extend in forward diverging relationship to each other, and respectively terminate at forward ends of said opposite side walls; a second pair of right- and left-hand horn walls extending between and cooperating with said bottom and lower interior walls so as to define a lower bass horn; said second pair of horn walls respectively being shaped and disposed identically to said first pair of horn walls; third and fourth pairs of right- and left-hand horn walls extending between and cooperating with said upper and lower interior walls so as to define right- and left-hand mid/high frequency horns located on opposite sides of said plane, with the third pair of horn walls having respective rear ends spaced from each other and located towards the rear of said cabinet so as to define a third throat from which said third pair of walls extend in forward diverging relationship to each other and respectively terminate at the forward edge of a respective one of the side walls and at a location on said plane at the front of the cabinet, and with the fourth pair of horn walls being respectively identical to and arranged in mirror image fashion relative to said third pair of horn walls.

7. The loudspeaker, as defined in claim 6, wherein said opposite side walls of said cabinet diverge from each other toward a forward side of the cabinet at such an angle as to permit said cabinet to be arrayed with identical cabinets in side-by-side relationship to each other with adjacent sides of said cabinets being in contact with each other throughout their dimensions from front to rear.

8. The loudspeaker, as defined in claim 6, wherein said mid/high frequency horns each converge to a point on said central plane, which point is on an axis of an imaginary cylinder which intersects said forward edges of said opposite side walls.

9. The loudspeaker, as defined in claim 8, wherein respective vertical planes containing said opposite side walls make an angle of 30° with each other at said axis.

10. The loudspeaker, as defined in claim 9, wherein respective vertical planes located centrally between said third pair of horn walls and between said fourth pair of horn walls make an angle of 15° at said axis.

11. The loudspeaker, as defined in claim 6, wherein said first, second, third and fourth pairs of horn walls are each vertical.

12. The loudspeaker, as defined in claim 11, wherein said first, second, third and fourth pairs of horn walls are each defined by smooth curves from rear to front.

13. The loudspeaker, as defined in claim 12, wherein said smooth curves are continuously varying exponential curves.

* * * * *